US005489150A

United States Patent [19]

Whiteman, Jr.

[11] Patent Number: 5,489,150

[45] Date of Patent: Feb. 6, 1996

[54] MORTAR MIXER FRAME HAVING INTEGRAL HYDRAULIC FLUID RESERVOIR WITH MEANS FOR COOLING THE HYDRAULIC FLUID

[75] Inventor: Marvin E. Whiteman, Jr., Boise, Id.

[73] Assignee: Whiteman Industries, Inc., Boise, Id.

[21] Appl. No.: 370,737

[22] Filed: Jan. 10, 1995

[51] Int. Cl.[6] ..... B28C 5/14; B28C 7/16

[52] U.S. Cl. ..... 366/46; 366/47; 366/61; 366/62; 366/143

[58] Field of Search ..... 366/45–48, 60–63, 366/64–67, 143, 185, 189, 194–196, 606

[56] References Cited

U.S. PATENT DOCUMENTS

| | | | |
|---|---|---|---|
| 1,582,357 | 4/1926 | Talbot et al. | 366/66 |
| 1,708,947 | 4/1929 | Jaeger | 366/67 |
| 1,848,959 | 3/1932 | Longenecker | 366/45 x |
| 3,062,515 | 11/1962 | Green | 366/47 |
| 4,097,926 | 6/1978 | Face, Jr. | 366/46 |
| 4,134,686 | 1/1979 | Hauser et al. | 366/47 |
| 4,478,515 | 10/1984 | Tobin | 366/67 |
| 4,877,327 | 10/1989 | Whiteman, Jr. | 366/185 X |
| 5,061,077 | 10/1991 | Whiteman, Jr. | 366/46 X |
| 5,067,818 | 11/1991 | Howe | 366/67 X |
| 5,094,540 | 3/1992 | Face, Jr. | 366/46 |

*Primary Examiner*—David Scherbel
*Assistant Examiner*—Charles E. Cooley
*Attorney, Agent, or Firm*—Frank J. Dykas

[57] ABSTRACT

A motar mixer driven by a hydraulic pump and motor which are powered by an gasoline engine. The mixer frame is configured as a trailer to facilitate transport of the mortar mixer. The trailer frame is further adapted so that the frame members form a fluid reservoir for the hydraulic fluid for the system. A tubular steel frame assembly, is manufactured so that the inner chambers of the frame members are in fluid communication with one another. A reservoir dam is placed inside the horizontal trailer frame member to provide a crush zone for eliminating risk of damage to the reservoir in the event that the weld that secures the front trailer frame member to the horizontal trailer frame member fails or fractures. Cooling of the hydraulic fluid and engine/pump compartment is accomplished by creating a flow of ambient air through a duct which passes along the side of and is affixed to the horizontal trailer frame member, the flow of air being generated by a squirrel cage fan which is attached directly to and rotates with the output shaft of the hydraulic pump.

4 Claims, 5 Drawing Sheets

MORTAR MIXER FRAME HAVING INTEGRAL HYDRAULIC FLUID RESERVOIR WITH MEANS FOR COOLING THE HYDRAULIC FLUID

BACKGROUND OF THE INVENTION

TECHNICAL FIELD

This invention generally relates to an improved mortar mixer having a reservoir for hydraulic fluid for a hydraulic drive mechanism, the reservoir being manufactured integrally within the mortar mixer frame, the integral reservoir having heat exchanging means and crush proof construction.

BACKGROUND ART

Present day mortar mixers are typically constructed having a frame, a drum mounted within the frame, paddles within the drum for mixing the mortar, a drive mechanism for rotating the paddles within the drum, wheel assemblies mounted to the frame so that the mixer may be transported and a hitching assembly comprised typically of a tongue and trailer hitch so that the mixer may be attached to a towing ball on a vehicle for transport.

Typically, mortar mixers employ a cylindrically shaped drum, horizontally disposed and open along the top side. A plurality of metal mixing paddles and wipers axially and rotatably secured within the drum. A rotation means is provided to rotate a paddle axle to facilitate mixing the mortar. In smaller models of mortar mixers this rotation means is typically accomplished by a gasoline engine or an electric motor. The gasoline engine or electric motor is typically coupled to a mechanical clutch and gear reduction mechanism for transferring the rotational force of the gasoline engine or an electric motor which typically operates at or about 1200 RPM, into the rotational force which is applied to the paddles, through a paddle shaft, at a rate of approximately 30–45 RPM. In the heavier and larger industrial models, the use of a mechanical clutch has proved troublesome with breakdown of this part occurring often resulting in downtime for repair. Therefore, in the heavier and larger industrial mixers, the rotation means is often accomplished by employing a hydraulic drive mechanism.

The technology of torque transfer via hydraulics is old and well known. A hydraulic pump is coupled to a power source, in this case, a gasoline engine. The hydraulic pump draws a fluid, typically an oil, through the pump from a reservoir or sump. The pump is often coupled with a valving means so that the flow of hydraulic fluid may be regulated. From the pump and valving means, the fluid continues on to a motor where the hydraulic fluid impinges upon a set of impellers causing a shaft to rotate. The fluid continues on past the rotors through a return line to the reservoir. During this cycle, the hydraulic fluid is heated due in part to compression by the pump and in part to friction. The typical mortar mixer is designed to mix between six and eight cubic feet of mortar at a time. A load of mortar can weigh between 800 to 1,600 pounds. A substantial amount of torque, and as a result a substantial amount of heat, is generated by the system. As the fluid is heated it becomes less viscous. As the fluid becomes less viscous, the torque created by the motor decreases.

It is, therefore, desirable and necessary to cool the hydraulic fluid during the cycle so that the performance characteristics of the system do not vary during mixer operation. However, finding an effective means for cooling the hydraulic fluid in this application has proven difficult due primarily to the compact construction of the mixing apparatus.

Likewise, finding a location for a hydraulic fluid reservoir has been difficult due to the compact construction of the mixing apparatus. There is limited space available under the cowling and cooling problems already exist under the cowling without adding to the problem by adding a reservoir and some sort of an effective heat exchanger to cool the hydraulic fluid.

In considering the possibility of incorporating the hydraulic fluid reservoir into the mixer frame in order to accomplish the design objective of maintaining the compact profile of the mixer, several problems arise. The first, providing an effective means for cooling the hydraulic fluid, has already been discussed. A second concern is found in the fact that the frame of the mixer assembly takes a substantial amount of abuse. The most often damaged portion of the frame assembly is the front frame member, specifically the point at which the front frame member is joined, typically by welding, to the horizontal frame member.

Damage to a trailer frame commonly occurs when a truck or other vehicle is backed up to the mixer in order to position the vehicle for attachment of the mixer to the vehicle. The vehicle is backed into the mixer colliding with the front frame member, eventually causing the weld that secures the front frame member to the horizontal frame member to fail or fracture. Should the fluid reservoir be incorporated into the frame assembly, it would have to be done in such a manner that should this weld fail, there would be no risk of damage to the reservoir.

What is needed is a mortar mixer having a hydraulic drive means including a reservoir for the hydraulic fluid and a means for cooling the hydraulic fluid in the reservoir during the power cycle which are adapted to the compact construction of the mortar mixer in such a manner that in the event that the weld that secures the front frame member to the horizontal frame member fails or fractures, there would be no risk of damage to the reservoir. The fabrication of such a mixer would provide for a more compact and efficient hydraulically driven mortar mixer than that which is presently available.

DISCLOSURE OF INVENTION

These objects are accomplished by use of a mortar mixer frame, a drum mounted within the frame, with paddle means within the drum for mixing the mortar. The mortar mixer is provided with a hydraulic drive mechanism for rotating the paddles within the drum, wheel assemblies mounted to the frame so that the mixer may be transported and a hitching assembly comprised typically of a tongue and trailer hitch so that the mixer may be attached to a towing ball on a vehicle for transport.

The mortar mixer's drum is cylindrically shaped, horizontally disposed and open along the top side, the drum having generally vertical and circular end walls. A plurality paddle means consisting of mixing paddles and wipers are axially and rotatably secured within the drum, disposed along a paddle axle. A hydraulic motor is coupled to the paddle axle to rotate the paddle axle to mix the mortar.

The hydraulic motor is driven by a hydraulic pump which is coupled to a power source, in this case, a gasoline engine. The hydraulic pump draws a fluid, typically an oil, through the pump from a reservoir or sump. The pump is coupled with a valving means so that the flow of hydraulic fluid may be regulated. From the pump and valving means, the fluid flows through a supply line to the hydraulic motor. The fluid continues on past the impellers of the hydraulic motor through a return line to the reservoir.

The fluid reservoir is integrally manufactured into the frame assembly, specifically, the rear frame member and the tubular horizontal frame member. The frame assembly is manufactured using rectangular steel tubing. The fluid reservoir is formed by joining the rear frame member and the horizontal frame member in such a manner that the members are joined by welding, such that the rear frame member is perpendicular to the tubular horizontal frame member and the inner chambers of the tubular frame members are in fluid communication with one another.

A reservoir dam is placed inside the tubular horizontal frame member near the end of the tubular horizontal frame member which is joined to the front frame member. Placing the reservoir dam within the tubular horizontal frame member in this manner provides a means for eliminating risk of damage to the reservoir in the event that the weld that secures the front frame member to the tubular horizontal frame member fails or fractures.

Cooling of the hydraulic fluid is accomplished by creating a flow of ambient air through a duct which passes along the side of and is affixed to the tubular horizontal frame member. The flow of air is generated by a squirrel cage fan which is attached directly to and rotates with the output shaft of the hydraulic pump. The squirrel cage fan is enclosed in a fan shroud so that air is drawn into the fan and forced through the duct, alongside the tubular horizontal frame member which forms a part of the fluid reservoir, exhausting from the open end of the duct.

BEST MODE FOR CARRYING OUT INVENTION

Figure 1:
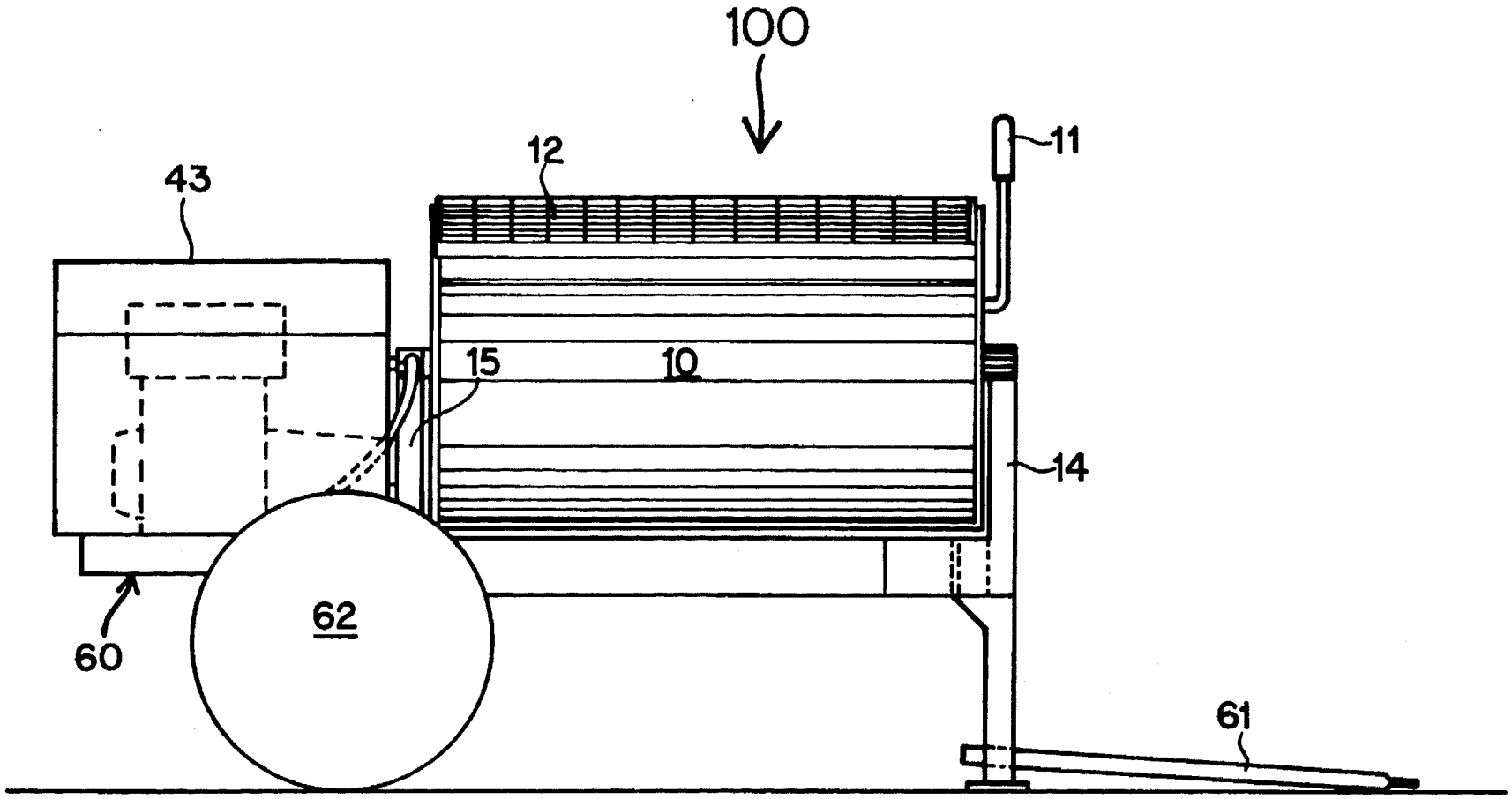
FIG. 1 is a side view of a mortar mixer.
Figure 2:
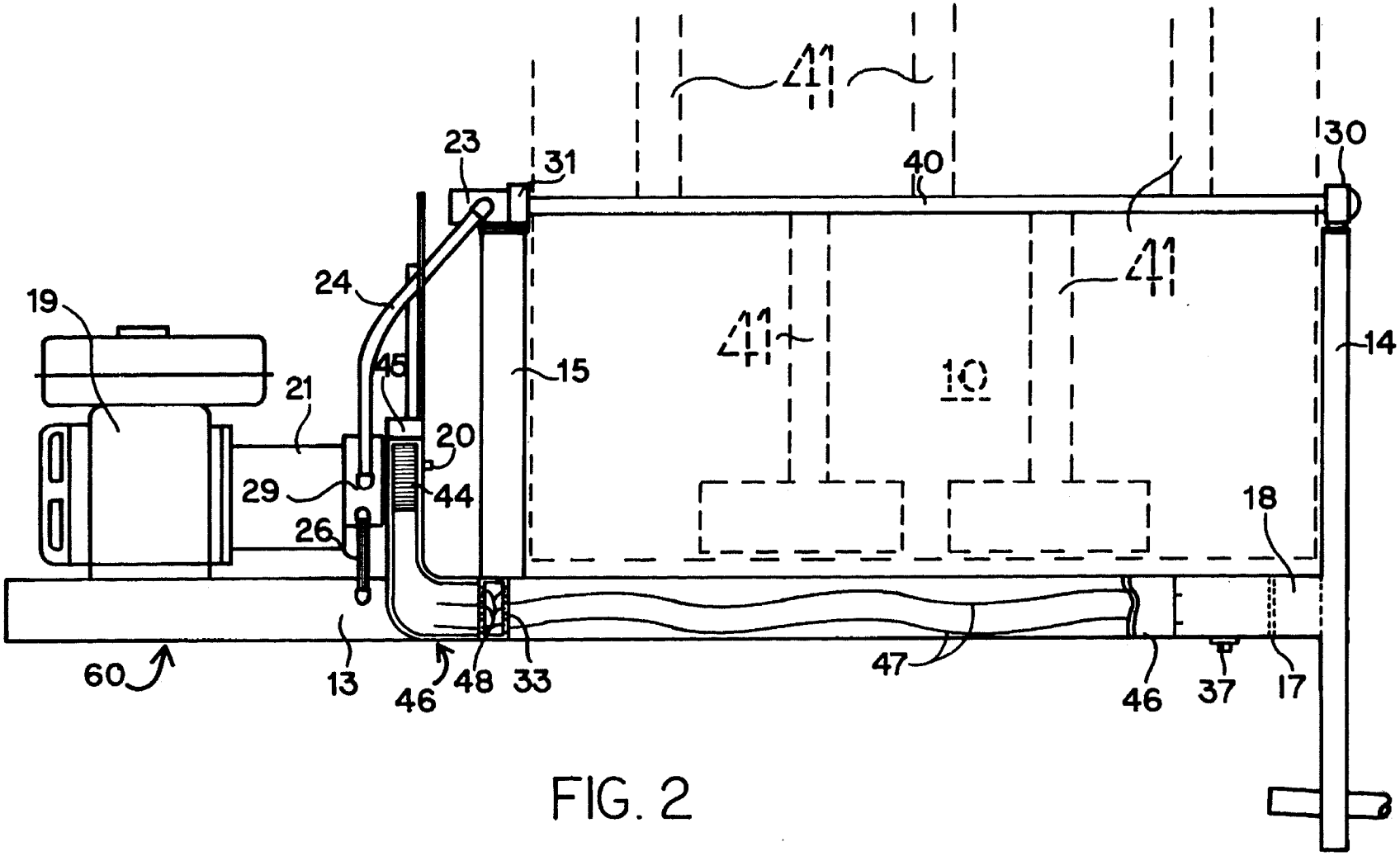
FIG. 2 is a sectional side view of a mortar mixer.
Figure 3:
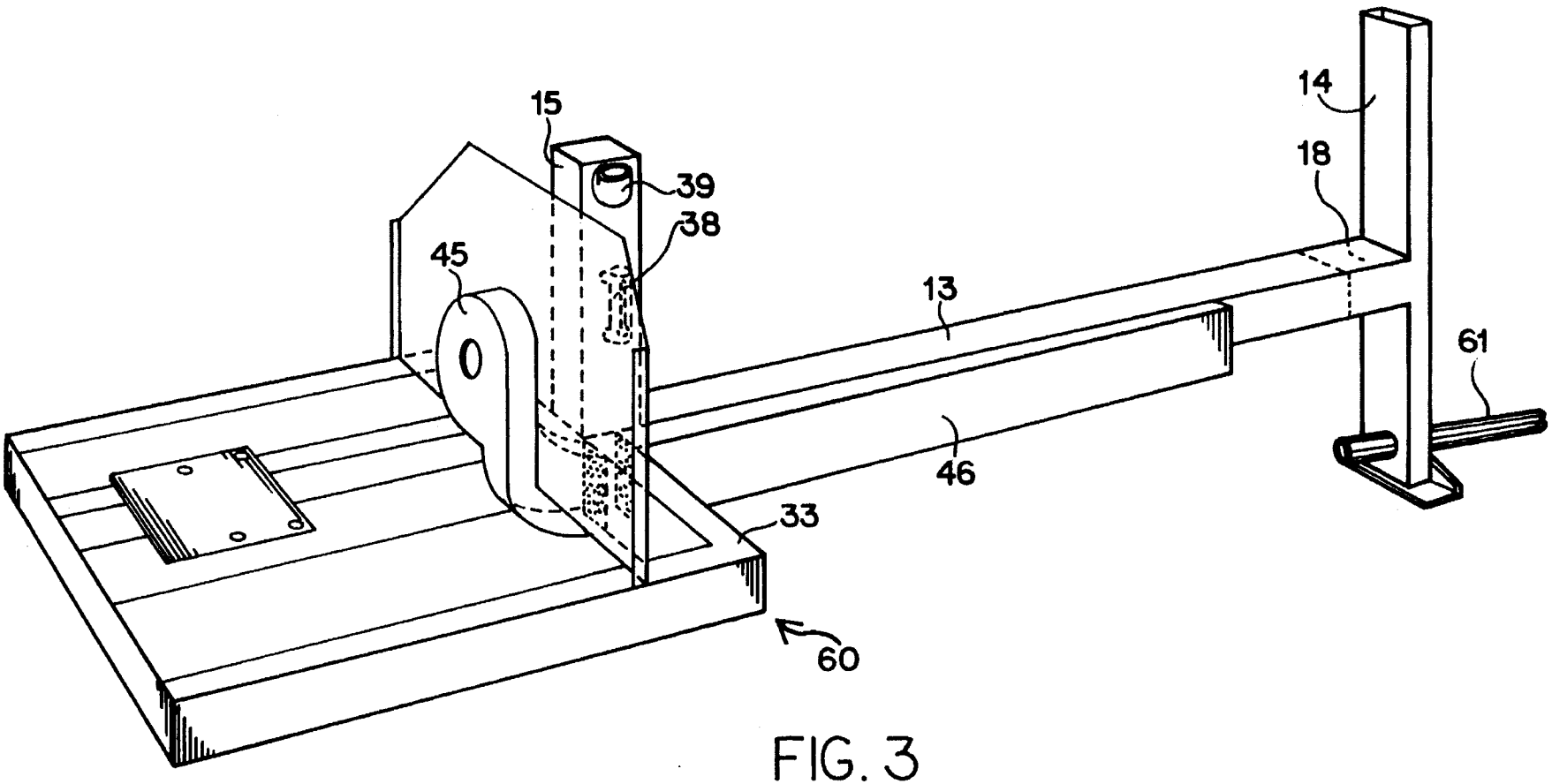
FIG. 3 is a representational perspective view of the mortar mixer frame showing the reservoir/frame, the air duct and the fan shroud and cooling fan system.
Figure 4:
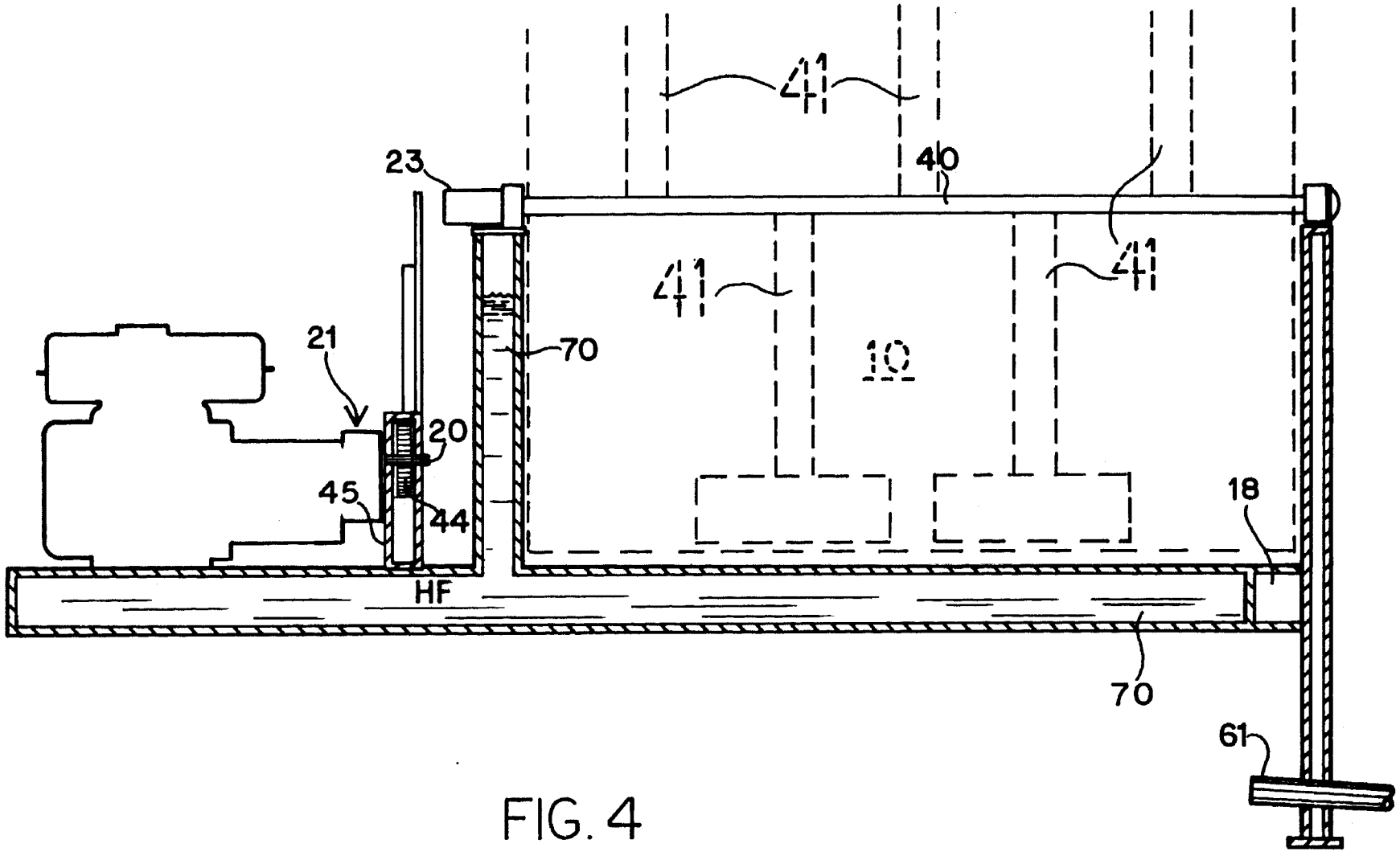
FIG. 4 is a sectional side view of a mortar mixer.
Figure 5:
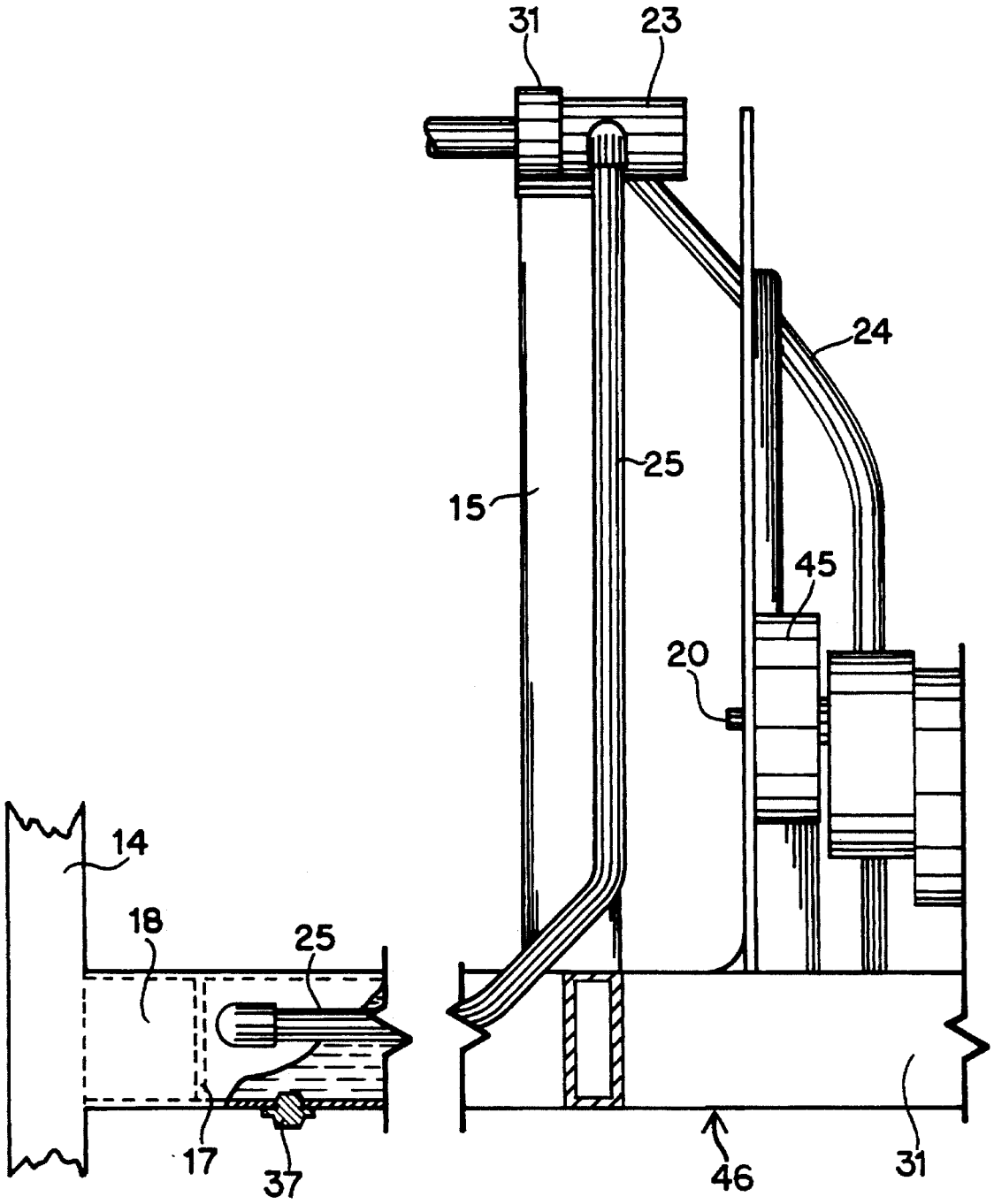
FIG. 5 is a partial side view showing a motor supply and return line.

As shown in FIGS. 1, 2, 3 and 4, mortar mixer 100 is provided with wheel assemblies 62 mounted to frame assembly 60 having hitching assembly 61 so that mortar mixer 100 may be readily transported.

Mixer drum 10 is supported by paddle shaft 40 which passes through first drum shaft assembly 30 and second drum shaft assembly 31 for rotational motion between a pair of vertical frame members, a front vertical frame member 14 and rear vertical frame member 15 which extend up from tubular horizontal frame member 13. First drum shaft assembly 30 and second drum shaft assembly 31 function in a dual rotational capacity in that they permit the rotation of the drum from an upright or mixing position wherein dumping grate 12, which spans and covers an elemental cylindrical segment opening in drum 10 are positioned atop the horizontally oriented drum assembly 10 to a dumping position where mixed mortar will spill out onto a mortar board or wheelbarrow, neither shown. Rotation of drum 10 from the mixing position to the dumping position is accomplished manually by an operator grasping drum handle 11 and pulling the same downward to rotate drum assembly 10.

A second rotational function served by first drum shaft assembly 30 and second drum shaft assembly 31 is to support, for rotation, paddle shaft 40 which in turn supports a plurality of paddle assemblies 41.

Since mortar mixers are used at remote construction sites, frame assembly 60 is transportable on wheel assemblies 62, and is provided with hitch assembly 61. In the preferred embodiment, gasoline engine 19 is mounted on trailer frame 60, inside cowling assembly 43. Paddle shaft 40 and paddle means 41 are rotatably and axially secured within drum assembly 10.

Paddle shaft 40 and paddle means 41 are rotated by hydraulic motor 23 which in turn is driven by hydraulic pump 21 coupled to gasoline engine 19. Hydraulic pump 21 draws hydraulic fluid HF through hydraulic pump 21 from reservoir 70. Hydraulic pump 21 is coupled with valving means 29 so that the flow of hydraulic fluid HF may be regulated. Hydraulic fluid HF is drawn by hydraulic pump 21 from reservoir 70 through supply line 26. From hydraulic pump 21 and valving means 29, hydraulic fluid HF flows through motor supply line 24 to hydraulic motor 23. Hydraulic fluid HF continues on past the impellers of hydraulic motor 23, through motor return line 25 to reservoir 70.

Reservoir 70 is integrally constructed within frame assembly 60. In the preferred embodiment, rear vertical frame member 15 and tubular horizontal frame member 13 are manufactured using rectangular steel tubing. Tubular horizontal frame member 13 comprises an open front end and an enclosed rear end. Reservoir 70 is formed by joining rear vertical frame member 15 and tubular horizontal frame member 13 by welding. so that rear vertical frame member 15 is perpendicular to tubular horizontal frame member 13 and the inner chambers of the tubular frame members are in fluid communication with one another. Sightglass 38 and fill spout 39 are located near the top end of rear vertical frame member 15. Drain plug 37 is located in the bottom side of tubular horizontal frame member 13.

Reservoir dam 17 is placed inside tubular horizontal frame member 13 near the open end tubular of horizontal frame member 13 which is joined to front vertical frame member 14. Reservoir dam 17 is offset within the open end of tubular horizontal frame member 13 some distance from front vertical frame member 14 so as to create frame crush zone 18.

Cooling of hydraulic fluid HF is accomplished by creating a flow of ambient air through duct 46 which passes along the side of and is affixed to tubular horizontal frame member 13. Air flow is generated by squirrel cage fan 44 which is attached directly to and rotates with output shaft 20. Squirrel cage fan 44 is enclosed in fan shroud 45 so that air is drawn into the center of squirrel cage fan 44 and forced through duct 46, alongside tubular horizontal frame member 13, which forms the lower segment reservoir 70, exhausting at the opposite open end of duct 46. Baffles 47 located within duct 46 increase the surface area for a more efficient heat transfer from reservoir 70 to the air. In the preferred embodiment, air holes 48 are drilled through wheel assembly subframe member 33 at the point at which fan shroud 45 and duct 46 abut allowing a flow of air through wheel assembly subframe member 33.

While there is shown and described the present preferred embodiment of the invention, it is to be distinctly understood that this invention is not limited thereto but may be variously embodied to practice within the scope of the following claims.

What is claimed is:

1. A mortar mixer comprising:

a generally horizontally oriented cylindrical mixer drum with generally vertical end walls;

paddle means rotatably and axially secured within the mixer drum;

a frame assembly, the frame assembly having a tubular horizontal frame member having a longitudinal axis, the tubular horizontal frame member having an open front end and an enclosed rear end, and a front vertical frame member and a rear vertical frame member, the cylindrical mixer drum being supported by and disposed between the front vertical frame member and the rear vertical frame member;

a dam offset within the tubular horizontal frame member a predetermined distance from the front vertical frame member and permanently affixed within the open front end of the tubular horizontal frame member, the dam being oriented in a plane perpendicular to the longitudinal axis of the tubular horizontal frame member forming a horizontal frame crush zone defined between the dam and the front vertical frame member and a hydraulic fluid reservoir having a predetermined capacity formed within and defined by the tubular horizontal frame member, the dam and the enclosed rear end of the tubular horizontal frame member;

a hydraulic power rotation means mounted on the frame assembly, the hydraulic power rotation means including a power supply means, operatively connected to a hydraulic pump by means of a rotating output shaft, a hydraulic motor in fluid communication with said hydraulic pump, and the hydraulic fluid reservoir containing a supply of hydraulic fluid, said hydraulic fluid reservoir being in fluid communication with the hydraulic pump and the hydraulic motor;

a fan for forcing cooling air attached to and rotating with the output shaft; and means for ducting cooling air forced from the fan into indirect heat exchange relationship with the hydraulic fluid within the hydraulic fluid reservoir formed within the tubular horizontal frame member.

2. The mortar mixer of claim 1 wherein said means for ducting cooling air forced from the fan into indirect heat exchange relationship with the hydraulic fluid within the hydraulic fluid reservoir formed within the tubular horizontal frame member further comprises:

a cooling air duct configured for directing a flow of cooling air against and along the outer surface of the tubular horizontal frame member; and a fan shroud enclosing the fan and in pneumatic communication with the cooling air duct.

3. The mortar mixer of claim 1 wherein the rear vertical frame member further comprises a rear vertical tubular frame member permanently affixed to and in fluid communication with the tubular horizontal frame member thereby increasing the capacity of the hydraulic fluid reservoir.

4. The mortar mixer of claim 1 wherein the means for ducting cooling air further comprises baffling means for increasing heat exchange surfaces for indirect heat exchange between the cooling air and the hydraulic fluid within the hydraulic fluid reservoir.

* * * * *